United States Patent [19]

Stone

[11] 3,965,803

[45] June 29, 1976

[54] METHOD OF FORMING REINFORCED CARTON

[76] Inventor: Orison W. Stone, Rte. 17, New Haven, Vt. 05472

[22] Filed: Apr. 5, 1974

[21] Appl. No.: 458,189

[52] U.S. Cl. ..... 93/36 M; 93/37 R; 93/58.4; 229/27

[51] Int. Cl.[2] ..... B31B 7/14

[58] Field of Search ..... 93/37 R, 37 SP, 37 EC, 93/36 R, 36 M, 58.4; 229/27, 42, 15, 28 R

[56] References Cited

UNITED STATES PATENTS

| | | | |
|---|---|---|---|
| 3,029,711 | 4/1962 | Griese | 93/37 R |
| 3,106,876 | 10/1963 | Dewhurst | 93/37 SP |
| 3,185,047 | 5/1965 | Struble et al. | 93/37 SP |
| 3,185,048 | 5/1965 | Struble | 93/37 SP |
| 3,189,244 | 6/1965 | Whalen | 229/42 X |
| 3,770,184 | 11/1973 | Rockefeller | 229/42 X |

*Primary Examiner*—James F. Coan
*Attorney, Agent, or Firm*—Burns, Doane, Swecker & Mathis

[57] ABSTRACT

A reinforcing panel for a rectangular tubular carton for large size granular products is provided by forming the carton blank with a reinforcing panel hingedly connected to one end of the carton blank. The reinforcing panel is folded first, over a flat blade, and the free end thereof is glued to one of the wider carton walls and then a sharp section of the flat blade is used to part the hinged end of the reinforcing panel from the carton blank, so that the hinged end can later be glued to the other one of the wider walls, as the carton blank is erected in the usual way.

14 Claims, 10 Drawing Figures

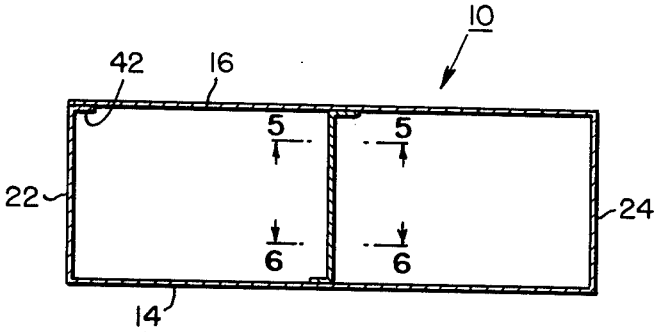
FIG. 4
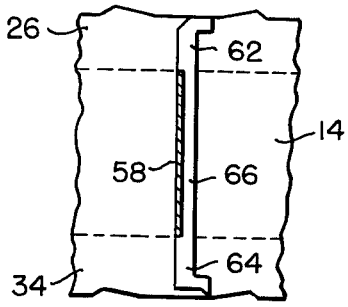
FIG. 6
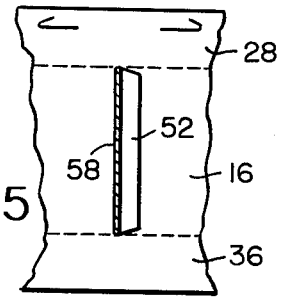
FIG. 5
FIG. 3
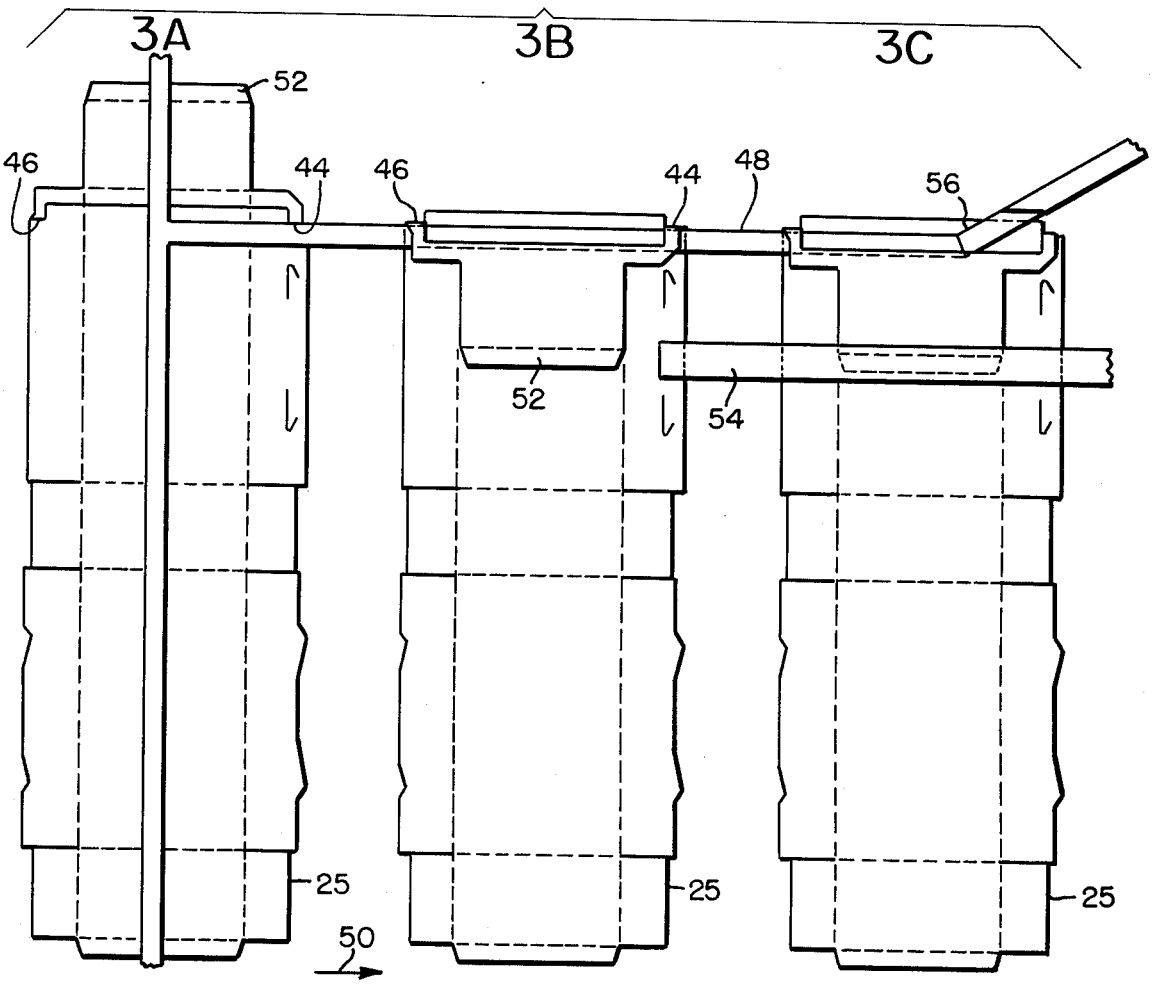

METHOD OF FORMING REINFORCED CARTON

BACKGROUND OF THE INVENTION

1. Field of the Invention

This invention relates to cartons and in particular to an improved reinforced carton, carton blank and method.

2. Description of the Prior Art

Reinforcing panels (also known as center dividers) are known for bracing the wider front and rear walls of a rectangular tubular carton for preventing the walls from bulging outwardly, allowing the use of thinner paperboard. However, the prior art cartons are each subject to various disadvantages which are overcome by the present claimed invention.

SUMMARY OF THE PRESENT INVENTION

A carton, carton blank, and method for providing a carton, such as a rectangular tubular carton of the type used for large size granular products such as soap, flour, etc, with a reinforcing panel connecting the central portions of the wider front and rear carton walls, to restrain them from bulging outwardly. This allows the use of paperboard of reduced thickness. The reinforcing panel is hinged to one end of the carton blank, is folded over first and the free (distal) end thereof is glued to approximately the center of one of the two wider walls, the hinged (proximal) end is then completely parted from the carton blank for later gluing to approximately the center of the other of the two wider walls, and the carton is then closed (erected in the normal way. The reinforcing panel can be designed to be swung or folded over to any position in the carton, even on an angle, if desired. The parting of the weakened hinge connection of the reinforcing panel to the carton blank is positive. One of the two glue flaps of the reinforcing panel can also have top and bottom portions glued to the top and bottom carton walls providing reinforcement there also. In cutting the carton blank, the reinforcing panel can be formed with two separated portions with a flow through space therebetween, and it can be cut so as to permit nesting with an identical reinforcing panel of the adjacent carton blank.

BRIEF DESCRIPTION OF THE DRAWINGS

The present invention will be more fully understood by reference to the following detailed description thereof, when read in conjunction with the attached drawings, wherein like reference numerals refer to like elements, wherein the dotted lines in the carton blanks designate hinge or fold lines of the carton blanks, and wherein:

FIG. 3 is a diagrammatic view showing a few steps of the method of the present invention;

FIG. 4 is a top view of the carton of FIG. 1 with the top open;

FIG. 5 is a cross-sectional view along lines 5—5 of FIG. 4;

FIG. 6 is a cross-sectional view along lines 6—6 of FIG. 4; and

DETAILED DESCRIPTION OF THE PREFERRED EMBODIMENTS

Figure 1:
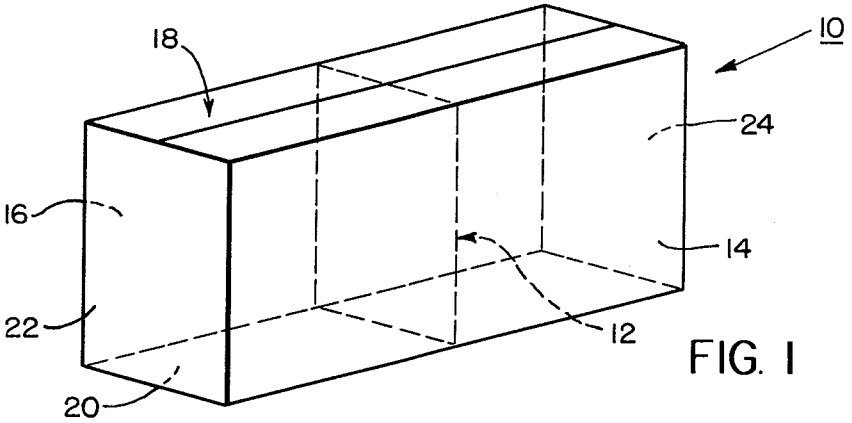
FIG. 1 is a diagrammatic, perspective view of a carton with a reinforcing panel according to the present invention.
Figure 2:
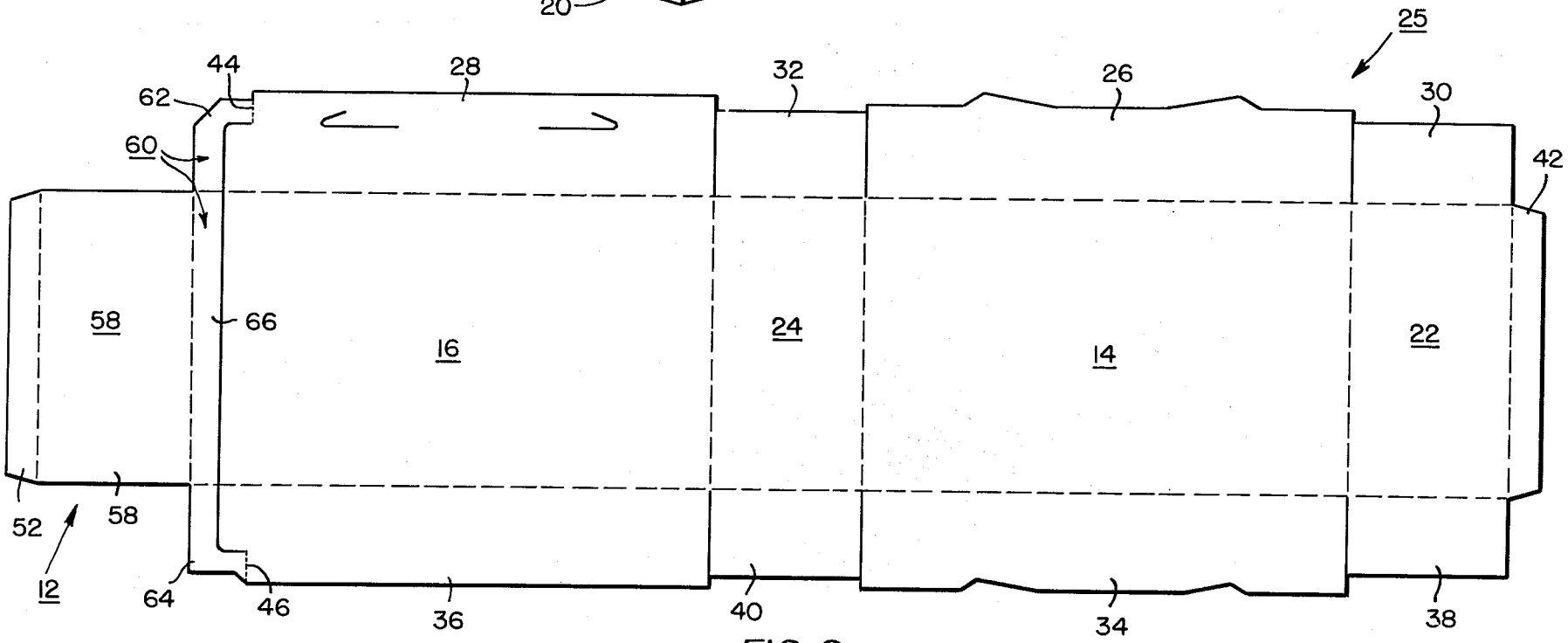
FIG. 2 is a top planar view of a carton blank used to make the carton of FIG. 1.

With reference now to the drawings, FIG. 1–6 show a first embodiment of the present invention including a carton 10 having a reinforcing panel 12 extending between a front wall 14 and a rear wall 16. The carton 10 includes a top wall 18, a bottom wall 20, a first end wall 22, and a second end wall 24. FIG. 2 shows a carton blank 25 (from which the carton 10 is made) including the front and rear walls 14 and 16, respectively and the first and second end walls 22 and 24 respectively, alternately hingedly connected together. The top wall 18 of the carton 10 includes a front top wall panel 26, a rear top wall panel 28, a first end top wall panel 30, and a second end top wall panel 32. The bottom wall 20 includes a front bottom wall panel 34, a rear bottom wall panel 36, a first end bottom wall panel 38, and a second end bottom wall panel 40. A glue flap 42 is hingedly connected to the first end wall 22.

The reinforcing panel 12 is hingedly connected along two weakened hinge lines 44 and 46, to the rear top wall panel 28 and to the rear bottom wall panel 36, respectively. The reinforcing panel 12 is completely cut away (along the heavy black line) from the remainder of the carton blank. The two panels 28 and 36, to which the reinforcing panel 12 is connected, will, in the carton 10, underlie the other two top and bottom panels 26 and 34 respectively.

With reference now to FIGS. 3A, 3B and 3C, in erecting the carton 10 from the carton blank 25, the reinforcing panel 12 is folded first; this is done over a flat blade 48, as the carton blanks 25 pass under the blade 48 in the direction of arrow 50. Pressure is then applied to the free side glue flap 52 of the reinforcing panel 12 (after glue has been applied thereunder), by means of a hold down belt (or roller) 54, to affix the reinforcing panel to one of the wider walls (in this case to the back wall 16). At this location, the flat blade 48 is bent at an angle away from the carton 10, and at the angle portion includes a sharp edge 56 such that the edge 56 easily cuts completely through the weakened hinge lines 44 and 46. The hinge lines 44 and 46 are preferably weakened when formed, for example, by alternating cuts extending therethrough. The carton blank 25 is then closed (erected) in the normal way, as will be readily understood by those skilled in the art, as a part of which erection the hinged side glue flap 60 of the reinforcing panel 12 is glued to the other of the wider walls (in this case to the front wall 14).

The reinforcing panel 12 includes a main support panel 58, a free side glue flap 52, and a hinged side glue flap 60 that includes a pair of "L" shaped straps 62 and 64 and a central glue flap section 66. The L shaped straps 62 and 64 can vary in length, width and shape to divide the carton 10 in its exact center, or off-center, simply by changing the location of the hinge lines 44 and 46 and/or the width of the glue flap 60. Alternatively, the panel brace 12 can be positioned at an angle if desired. The fact that the glue flap 60 extends beyond the front wall 14 and into contact with the front top and bottom wall panels 26 and 34, respectively, provides additional support for the top and bottom walls 18 and 20, and in the center thereof where it does the most good.

FIG. 4 is a top view of the carton 10 with the top walls 18 and 20 open to show the location of the reinforcing panel 12.

FIGS. 5 and 6 are views taken inside the open carton of FIG. 4 along lines 5—5 and 6—6 thereof, respectively, showing the location of the reinforcing panel 12 when glued in place inside the carton 10.

Figure 7:
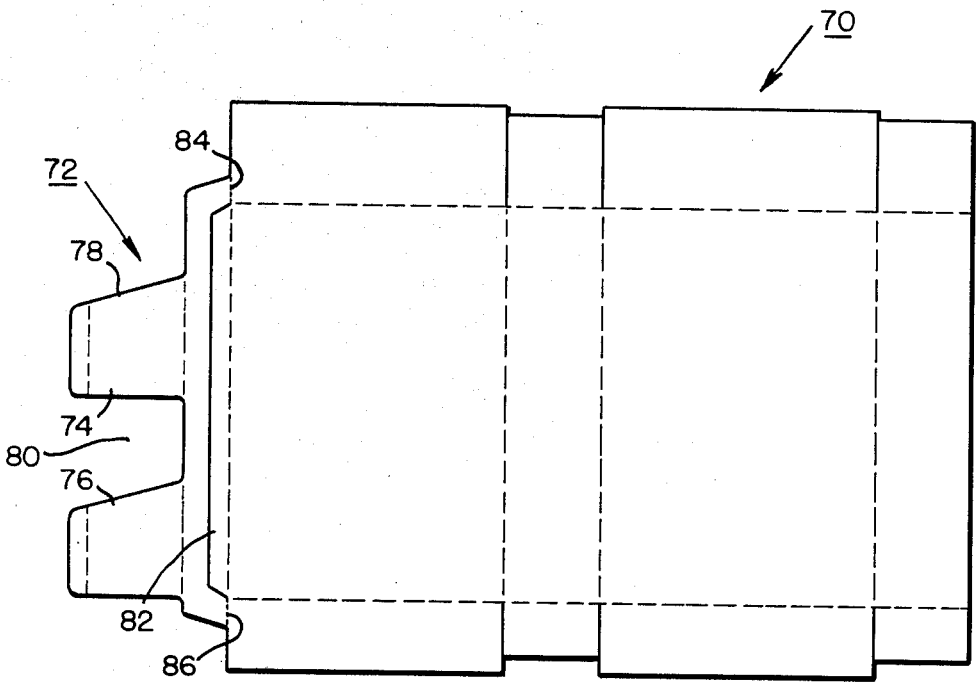
FIGS. 7–10 are each top planar views of additional carton blank embodiments of the present invention.

FIG. 7 is a plan view of a carton blank 70 of another embodiment of the invention. The carton blank 70 has a reinforcing panel 72 according to the present invention, formed with two main support panels 74 and 76. The space between the top 78 of the panel 74 and the top of a carton made from the carton blank 70 provides space for a filling head to enter the erected carton (not shown). The cutaway area 80 between the two panels 74 and 76 permits "flow through" of product on opposite sides of the reinforcing panel 72 during filling and emptying.

In this embodiment, the carton blank 70 includes a glue flap 82 located in-between the reinforcing panel 72 and the rest of the carton blank. It is further noted that the hinged connections 84 and 86 are located in-line with the edge of the panel to which the reinforcing panel is connected, rather than being inset a distance into the panel as in FIG. 1.

Figure 8:
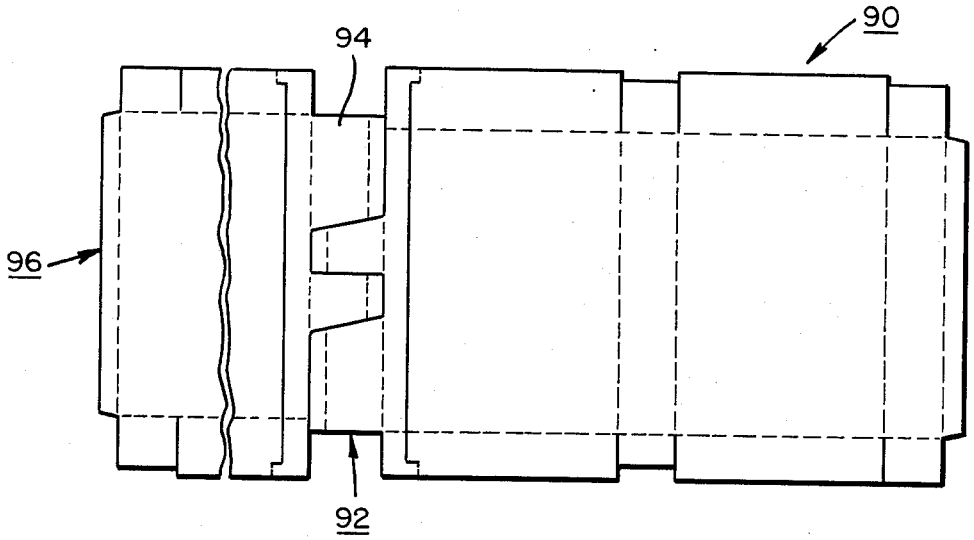

FIG. 8 is a plan view of a carton blank 90 of another embodiment of the present invention. In this embodiment, a reinforcing panel 92 is similar to that in FIG. 2 except that it has two separate portions with a flow-through area therebetween. In this embodiment the reinforcing panel 92 is nested, in the carton blank 90, with another reinforcing panel 94 of an adjacent carton blank 96.

Figure 9:
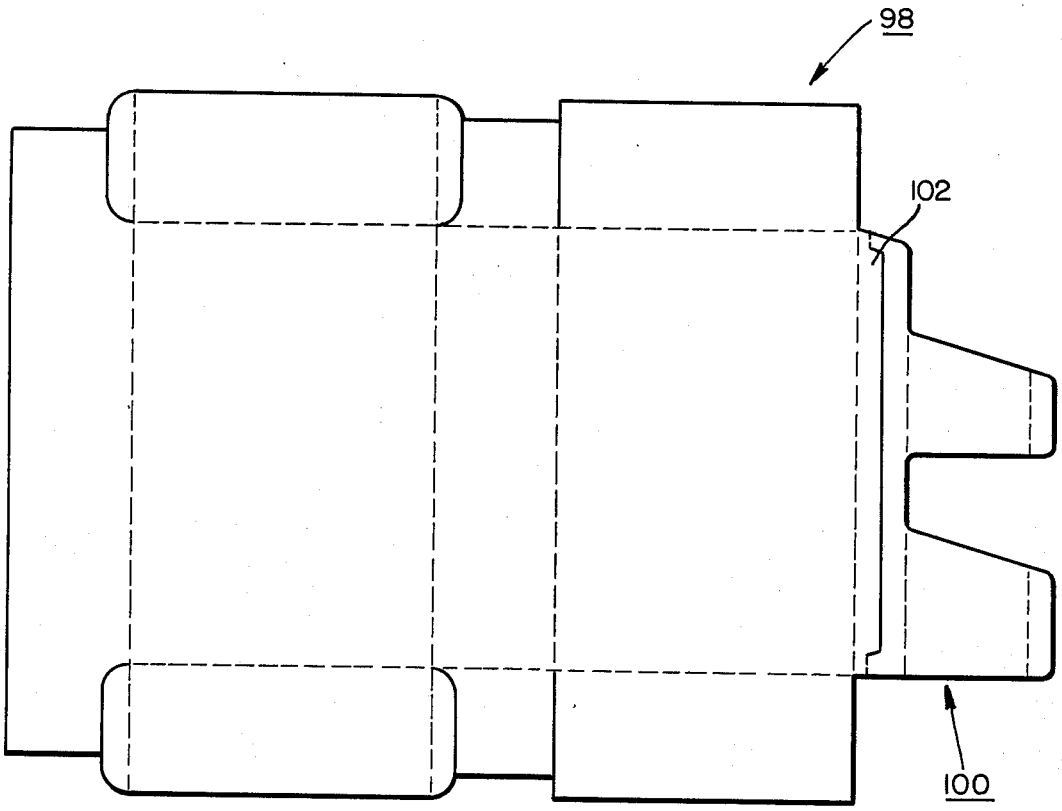

FIG. 9 is a plan view of a carton blank 98 of another embodiment of this invention, having a reinforcing panel 100 hingedly connected to a glue flap 102.

Figure 10:
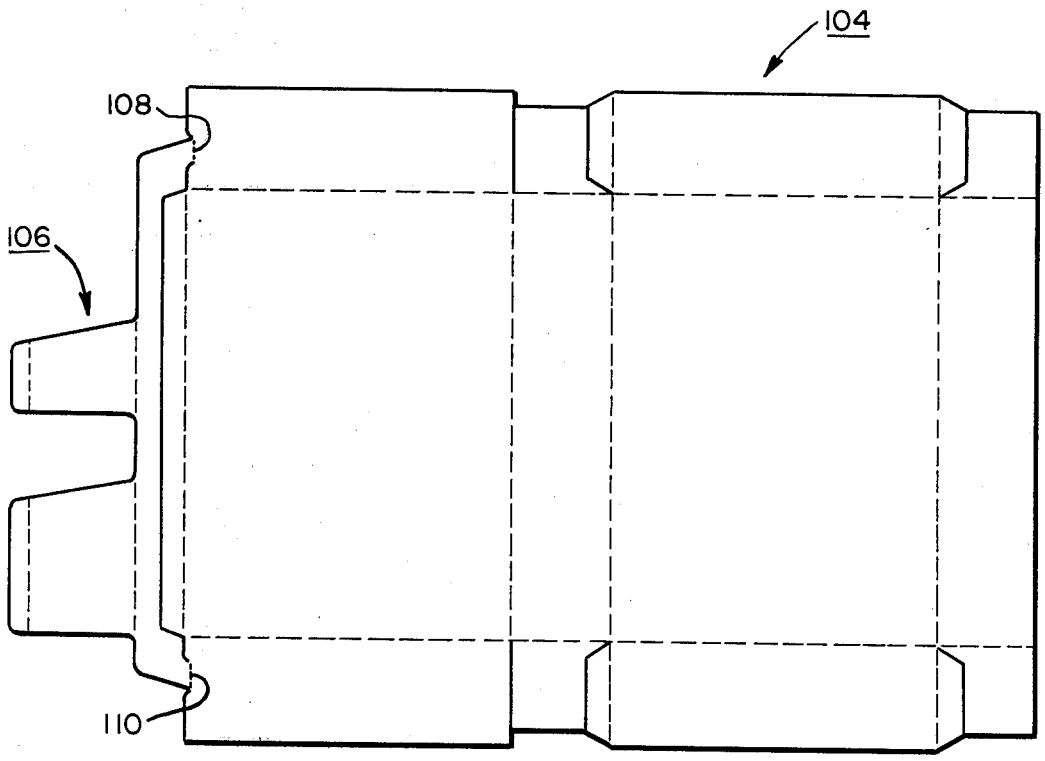

FIG. 10 is a plan view of a carton blank 104 according to another embodiment of this invention, having a reinforcing panel 106 hingedly connected at 108 and 110, respectively to the rest of the carton blank 104.

While the reinforcing panel has been shown above to be connected to the carton blank along that end of the carton blank which terminates with one of the wider (i.e. front or rear) walls, the reinforcing panel can alternatively be connected to the opposite end of the carton blank, i.e. to the end terminating with one of the narrower end panels. The glue flap of the carton blank can be at either end of the carton blank regardless of to which end the reinforcing panel is hingedly connected. While only two weakened hinge connections are shown between the reinforcing panel and the remainder of the carton blank, this is not essential, other numbers of weakened hinge connections can be used, such as, for example one or three. While the invention has been described with reference to a rectangular tubular carton, this is the preferred embodiment, however, the present invention is not limited to use in a rectangular tubular carton, but has application in a variety of other types of cartons including those having, for example, a pair of opposing first walls and a pair of opposing second walls, whether or not the walls of each pair are of identical size and shape, as will be clearly understood by anyone skilled in the art.

The invention has been described in detail with particular reference to the preferred embodiments thereof, but it will be understood that variations and modifications can be effected within the spirit and scope of the invention as described hereinabove and as defined in the appended claims.

I claim:

1. A method for forming a tubular carton having a pair of opposed first walls, a pair of opposed second walls, and a reinforcing panel extending between said first walls, comprising:

providing a carton blank including a pair of first walls and a pair of second walls, alternatively hingedly connected together;

providing said carton blank with a reinforcing panel hingedly connected to one end of said carton blank, said reinforcing panel having a glue flap at each long side thereof, one being at a free side thereof and one being at a hinged side thereof;

folding said reinforcing panel, at its hinged connection, over on top of said carton blank and gluing the free side glue flap to one of said first walls;

parting said hinged connection between said reinforcing panel and carton blank;

erecting said carton blank into a carton including gluing said hinged side glue flap to the other one of said first walls; and hingedly connecting said reinforcing panel at two spaced-apart locations, one being at a rear top wall panel and the other at a rear bottom wall panel.

2. A method of forming a tubular carton having a pair of opposed first walls, a pair of opposed second walls and a reinforcing panel extending between said first walls, comprising:

obtaining a carton blank having a pair of first walls, a pair of second walls, and a reinforcing panel, the first walls and the second walls being hingedly connected to one another with one of the first walls between both of the second walls and with one of the second walls between both of the first walls, said reinforcing panel being hingedly connected to an end of the carton blank adjacent to one of the first walls but being separated therefrom;

folding the carton blank at the hinged connection of the reinforcing panel such that the reinforcing panel overlies a portion of the carton blank;

gluing the reinforcing panel to one of the first walls;

separating the reinforcing panel from the carton blank along the hinged connection therebetween;

gluing the reinforcing panel to the other one of said first walls;

erecting the carton blank into a carton; and wherein the step of obtaining a carton blank includes the steps of obtaining a carton blank having end closure panels extending from the first walls; and hingedly connecting the reinforcing panel to one of the end closure panels.

3. A method for forming a tubular carton having a pair of opposed first walls, a pair of opposed second walls, and a reinforcing panel extending between said first walls, comprising:

providing a carton blank including a pair of first walls and a pair of second walls, alternatively hingedly connected together, and further including a reinforcing panel hingedly connected to one end of said carton blank adjacent to one first panel but separated from said one first panel, said reinforcing panel having a glue flap at a free side thereof and another glue flap at a hinged side thereof;

folding said reinforcing panel, at its hinged connection, over on top of said carton blank and gluing the free side glue flap to one of said first walls;

parting said hinged connection between said reinforcing panel and carton blank;

erecting said carton blank into a carton including gluing said hinged side glue flap to the other one of said first walls; and wherein said parting step includes folding said reinforcing panel over a flat blade having a portion that angles off with a sharp edge at the angle and moving said carton blank past said sharp edge such that said edge cuts through said hinged connection of said reinforcing panel.

4. The method according to claim 3 including hingedly connecting said reinforcing panel to said carton blank at such location that said free side glue flap of said reinforcing panel will be located at a predetermined position after said folding step.

5. The method according to claim 4 wherein said predetermined position is in the center of said one of said wider walls.

6. The method according to claim 3 including hingedly connecting said reinforcing panel to a glue flap of said carton blank.

7. The method according to claim 3 wherein said carton is a rectangular tubular carton and said pair of first walls are a pair of wider, identical width front and rear walls, and said pair of second walls is a pair of identical width narrower end walls.

8. The method according to claim 7 including positioning said reinforcing panel at that end of said carton blank terminating in a wider wall.

9. The method according to claim 8 including positioning a glue flap of said carton at the other end of said carton blank terminating in a narrower wall.

10. The method according to claim 8 including positioning a glue flap of said carton blank in-between said reinforcing panel and the wider wall adjacent said reinforcing panel and hingedly connecting said glue flap to said wider wall.

11. The method according to claim 10 including maintaining said glue flap completely parted from said reinforcing panel.

12. A method for forming a tubular carton having a pair of opposed first walls, a pair of opposed second walls, and a reinforcing panel extending between said first walls comprising:

providing a carton blank including a pair of first walls and a pair of second walls, alternatively hingedly connected together;

providing said carton blank with a reinforcing panel hingedly connected to one end of said carton blank, said reinforcing panel having a glue flap at each long side thereof, one being at a free side thereof and one being at a hinged side thereof;

folding said reinforcing panel, at its hinged connection, over on top of said carton blank and gluing the free side glue flap to one of said first walls;

parting said hinged connection between said reinforcing panel and carton blank;

erecting said carton blank into a carton including gluing said hinged side glue flap to the other one of said first walls;

providing said carton blank for a rectangular tubular carton and said pair of first walls are a pair of wider, identical width front and rear walls, and said pair of second walls is a pair of identical width narrower end walls;

positioning said reinforcing panel at that end of said carton blank terminating in a wider wall;

positioning a glue flap of said carton in-between said reinforcing panel and the wider wall adjacent said reinforcing panel and hingedly connecting said glue flap to said wider wall; and hingedly connecting said reinforcing panel to said glue flap.

13. A method of forming a tubular carton having a pair of opposed first walls, a pair of opposed second walls and a reinforcing panel extending between said first walls, comprising:

obtaining a carton blank having a pair of first walls, a pair of second walls, and a reinforcing panel, the first walls and the second walls being hingedly connected to one another with one of the first walls between both of the second walls and with one of the second walls between both of the first walls, said reinforcing panel being hingedly connected to an end of the carton blank adjacent to one of the first walls but being separated therefrom;

folding the carton blank at the hinged connection of the reinforcing panel such that the reinforcing panel overlies a portion of the carton blank;

gluing the reinforcing panel to one of the first walls;

separating the reinforcing panel from the carton blank along the hinged connection therebetween;

gluing the reinforcing panel to the other one of said first walls;

erecting the carton blank into a carton; and wherein the step of folding includes the steps of positioning the carton blank under a cutting edge member having a straight portion and an inclined portion; and folding the carton blank about the straight portion of the cutting edge member at the hinged connection.

14. The method of claim 13 wherein the step of separating includes the steps of:

moving the folded carton blank along the straight portion of the cutting edge member; and severing the reinforcing panel from the carton blank by cutting the hinged connection therebetween with the inclined portion of the cutting edge member.

* * * * *